US005578058A

United States Patent [19]

Chen

[11] Patent Number: 5,578,058

[45] Date of Patent: Nov. 26, 1996

[54] HYGIENIC PACIFIER SHIELDED WITH BIVALVE SHELL

[76] Inventor: Chean-Shui Chen, c/o Hung Hsing Patent Service Center P.O. Box 55-1670, Taipei, Taiwan

[21] Appl. No.: 573,126

[22] Filed: Dec. 15, 1995

[51] Int. Cl.[6] ..... A61J 17/00

[52] U.S. Cl. ..... 606/236; 606/234

[58] Field of Search ..... 606/234–236; 604/77; D24/194–199

[56] References Cited

U.S. PATENT DOCUMENTS 5,156,617 10/1992 Reid ..... 606/236

FOREIGN PATENT DOCUMENTS 2240723 8/1991 United Kingdom ..... 606/234

*Primary Examiner*—Glenn Dawson

[57] ABSTRACT

A hygienic pacifier includes: a base member; a nipple member having a nipple portion protruding from a first side of the base member; a handle secured to the base member on a second side of the base member; and a bivalve shell hingedly secured to the base member. The bivalve shell has a pair of half-shell pieces separable and openable beyond a baby's mouth to reveal the nipple portion to be soothed by the baby, and the pair of half-shell pieces is foldably closable for shielding the nipple portion within the half-shell pieces for preventing contamination of the nipple portion.

8 Claims, 3 Drawing Sheets

HYGIENIC PACIFIER SHIELDED WITH BIVALVE SHELL

BACKGROUND OF THE INVENTION

Joseph W. Russell et al. disclosed a sanitary baby pacifier in their U.S. Pat. No. 4,819,641 comprising a pair of opposed generally dome shaped members coupled by a collapsible wall portion, in which the two handles (30, 31) should be drawn downwardly through the slots (41, 41) to retract the bellows-like side wall (15) and the spherical portion (16) so as to protrude the nipple (51) forwardly to be pacified by a baby by forcing the nipple (51) through the slot (12) cut in the spherical portion (16). However, such a sanitary pacifier may have the following drawbacks:

1. For protruding the nipple for pacifying use from its retracted position within the bellows-like domed structure (16, 15, 19), the handles should be rearwardly withdrawn to squeeze the nipple through the slot (12). Since the nipple is generally made of resilient flexible elastomeric material, it will be very difficult to smoothly protrude the nipple through the slot. If the fingers of the user pull the spherical portion (16) to widen the slot aperture for an: easy protruding of the nipple, the nipple may be easily contaminated by the fingers, possibly endangering a baby's hygiene and health.

2. The two handles (30, 31) are always protruded outwardly from the base member (20) to occupy a large volume, inconvenient for storage or shipping.

3. The nipple is reciprocatively extended or retracted through the slot (12) and easily polluted by the dirt or contaminants accumulated on the slot (12), which is harmful for the baby's health.

Even though Zade disclosed a sanitary retractable baby pacifier in his U.S. Pat. No. 5,366,481 comprising a nipple retractable and, extendable within a cylindrical storage container, the pacifier still occupies a large volume and will be inconveniently pacified by a baby since the cylindrical storage container will cause a heavy load or bending moment on the nipple to be transferred to the baby possibly deforming the baby's teeth.

The present inventor has found the drawbacks of the conventional sanitary pacifiers, and invented the hygienic pacifier for a more convenient use and storage and for preventing its contamination.

SUMMARY OF THE INVENTION

The object of the present invention is to provide a hygienic pacifier including: a base member; a nipple member having a nipple portion protruding towards a first side of the base member; a handle secured to the base member on a second side of the base member; and a bivalve shell hingedly secured to the base member and having a pair of half-shell pieces separable and openable beyond a baby's mouth to reveal the nipple portion to be soothed by the baby, and the pair of half-shell pieces foldably closed for shielding or encasing the nipple portion within the half-shell pieces for preventing contamination of the nipple portion.

DETAILED DESCRIPTION

Figure 1:
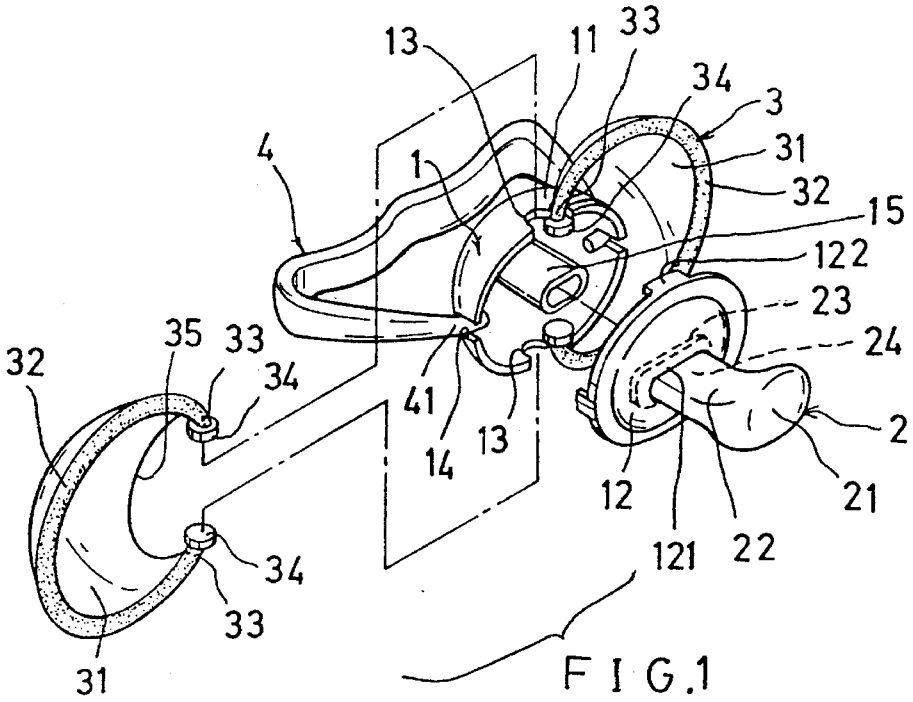
FIG. 1 is an exploded view of the present invention.

As shown in FIGS. 1–7, a hygienic pacifier of the present invention comprises: a base member 1, a nipple member 2 secured to or formed on the base member 1 at a first side of the base member 1, a handle 4 secured to the base member 1 at a second side of the base member 1 opposite to the nipple member 2, and a bivalve shell 3 hingedly secured to the base member 1.

The base member 1 includes: a base portion 11, a cover 12 combinable with the base portion 11 for forming the base member 1 for securing the nipple member 2 on the cover 12 and having a central slot 121 cut in a central portion of the cover 12 for protruding the nipple member 2 outwardly from the cover 12 and having a pair of lugs 122 disposed on two opposite side portions of the cover 12, a pair of pivoting slots 13 formed in two opposite side portions of the base portion 11 for pivotally connecting the bivalve shell 3, a pair of shaft holes 14 formed in two opposite side portions of the base portion 11 for pivotally connecting the handle 4, and a plugging stem 15 protruding from the base portion 11 towards the nipple member 2. Also, the stem 15 may also be detachably secured to the base member 1. The shaft hole 14 may be notched as similar as each pivoting slot 13, notched in the base member.

The handle 4 and the nipple member 2 may also be integrally formed with the base member 1.

Figure 4:
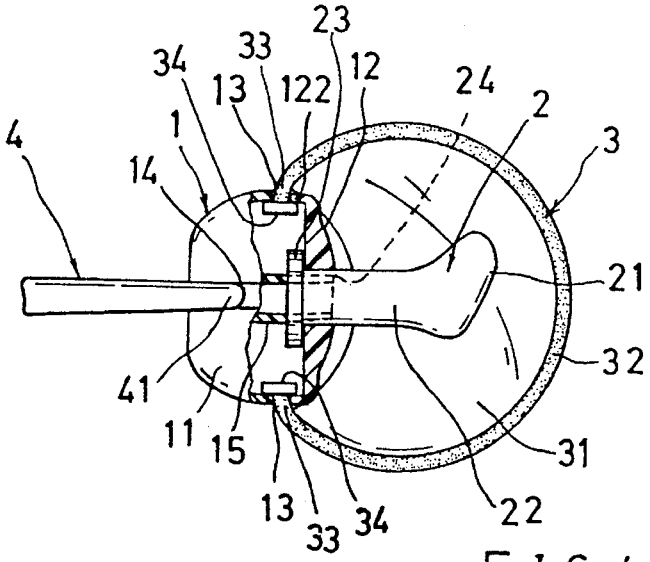
FIG. 4 is a partial sectional drawing of the present invention.

The nipple member 2 includes: a nipple portion 21 to be soothed by a baby, and a shank portion 22 integrally formed with the nipple portion 21 having a flange portion 23 formed on a bottom portion of the shank portion 22 to be retained on the cover 12 and having a hollow portion 24 formed in the flange portion 23 to be plugged by the plugging stem 15 of the base member 1 for firmly combining the nipple member 2 with the base member 1 as shown in FIG. 4.

The handle 4 may be generally formed as an U shape having a pair of shaft portions 41 disposed on two opposite ends of the handle 4, each shaft portion 41 pivotally engageable with each shaft hole 14 formed in the base member 1 for pivotally connecting the handle 4 on the base member 1.

The shapes and configurations of the bivalve shell 3, the base member 1, the nipple member 2 and the handle 4 are not limited in this invention.

The bivalve shell 3 includes: a pair of half-shell pieces 31 hingedly secured to the base member 1; each half-shell piece including a peripheral ring 32 formed on a periphery of the half-shell piece 31, and a pair of pivot portions 33 disposed on two ends of the ring 32 and respectively engageable with two pivoting slots 13 formed in the base member 1 allowing a pivotal movement of each half-shell piece 31 about the pivoting slot 13 in the base member 1 so as to separably open the two half-shell pieces 31 for revealing the nipple portion 21 of the nipple member 2 for baby's soothing.

Each half-shell piece 31 has a retaining portion 34 formed on an end portion of each pivot portion 33 to be limited within each pivoting slot 13 formed in the base member 1, and a notch 35 generally arcuate shaped and formed in an inner portion of the half-shell piece 31 to allow a free pivotal movement of the half-shell piece 31 on the base member 1 without being obstructed.

Each half-shell piece 31 is preferably formed as spherical, arcuate, oval or heart shapes, but not limited in the present invention. The shell 3 may be formed as transparent, translucent or opaque materials. For automatically closing the two half-shell pieces 31, a restoring spring (not shown) may be provided at the pivot portions 33 of the shell 3 for automatically restoring the two half-shell pieces 31 to a closed position to always keep the nipple portion 21 clean when not used for pacifying a baby.

Figure 3:
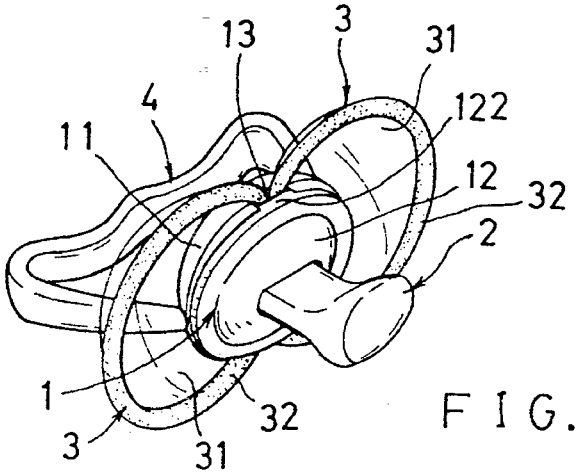
FIG. 3 is a perspective view of the present invention when opening the bivalve shell.

The pair of lugs 122 on the cover 12 may serve to confine the two pivoting slots 13 as shown in FIGS. 3, 4 when combining the cover 12 on the base portion 11 to form the base member 1.

The two peripheral rings 32 may well serve as grasping or holding purpose by a baby's nursing people or mother for opening or closing the two half-shell pieces 31.

Figure 7:
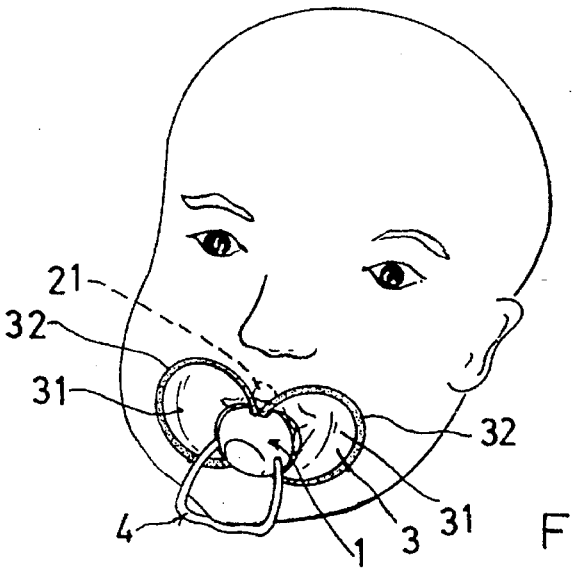
FIG. 7 is an illustration showing the pacifier soothed by a baby.

For opening the two half-shell pieces 31 as shown in FIG. 7, the nipple portion 21 will be revealed and inserted into the baby's mouth for soothing use, while the two half-shell pieces 31 will be rested upon the baby's cheek or face portion for a comfortable pacifying.

Figure 2:
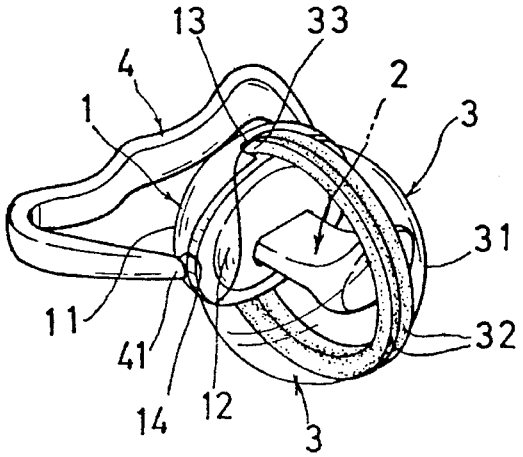
FIG. 2 is an illustration showing a closed pacifier of the present invention.
Figure 5:
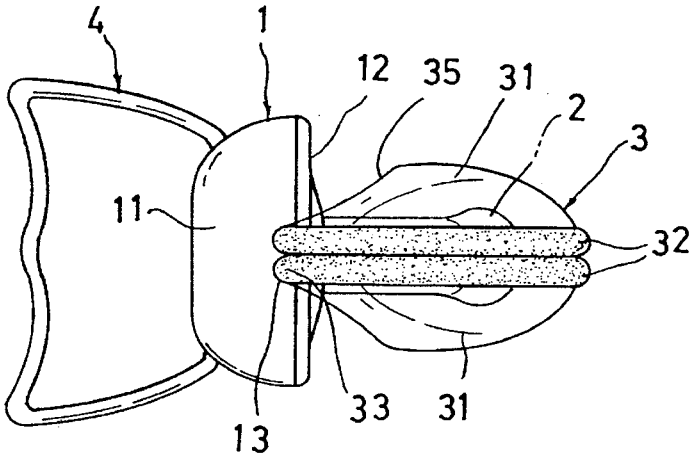
FIG. 5 is an illustration showing a pacifier with folded closed shell in accordance with the present invention.
Figure 6:
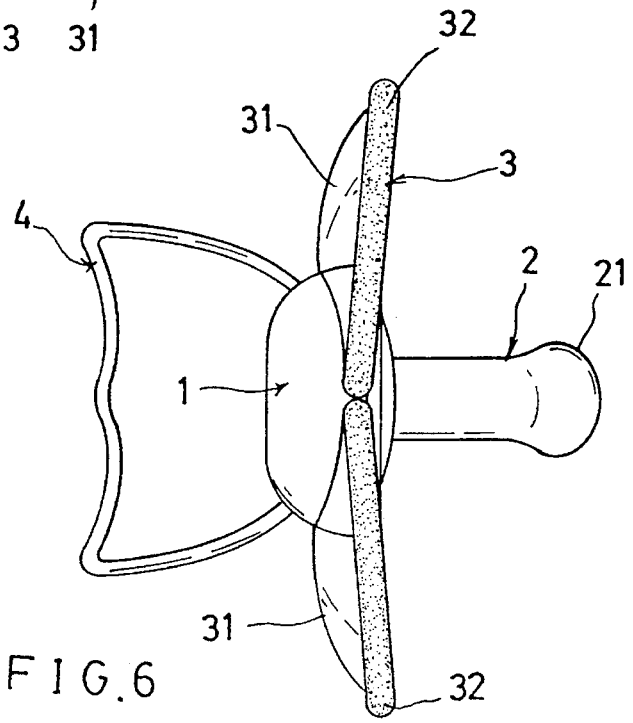
FIG. 6 is an illustration showing an opened shell of the pacifier from FIG. 5.

If not used, the two half-shell pieces 31 may be folded or closed as shown in FIGS. 5, 2 for shielding the nipple portion 21 within the two half-shell pieces 31 for preventing contamination of the nipple portion 21.

The present invention is superior to a conventional sanitary pacifier because of the following advantages:

1. The two half-shell pieces 31 can be conveniently opened for soothing, and closed for hygienically containing and protecting the nipple portion.

2. After folding the shell 3 and the handle 4 on the base member 1 and concealing the nipple member 1 within the shell 3, a small compact pacifier may be obtained for easy carrying, handling, storage and shipping.

3. Folding and unfolding mechanism is so simple, thereby greatly decreasing the production cost.

4. There is no redundant, complex, heavy or gigantic structure or configuration found in the present invention, thereby providing a light compact pacifier suitable for a baby and helpful for its health.

Figure 8:
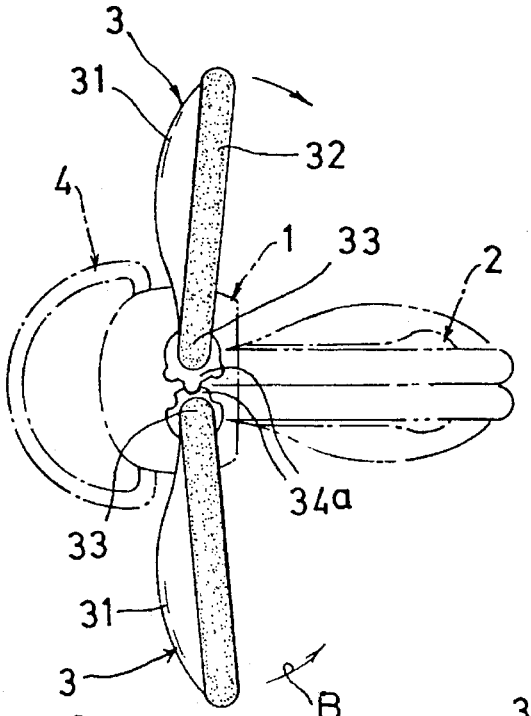
FIG. 8 is an illustration showing another preferred embodiment of the present invention.

Each half-shell piece 31 of the bivalve shell 3 may be modified to form a gear 34*a* on an inner end of each pivot portion 33 to be intermeshed with the other gear 34*a* of the other half-shell piece 31 as shown in FIG. 8, whereby upon an inward biasing (B) of any one of the half-shell pieces 31, the other half-shell piece 31 will be inwardly biased as driven by the meshed gears 34*a*, 34*a* for automatically closing the two half-shell pieces 31 for shielding the nipple portion 21 therein. When the pacifier of the present invention falls on the ground, an impact force from the ground will cause such a biasing movement as shown in FIG. 8 for automatically closing the shell 3 for hygienic purpose. This phenomena will add on the merits of the present invention as aforementioned.

Figure 9:
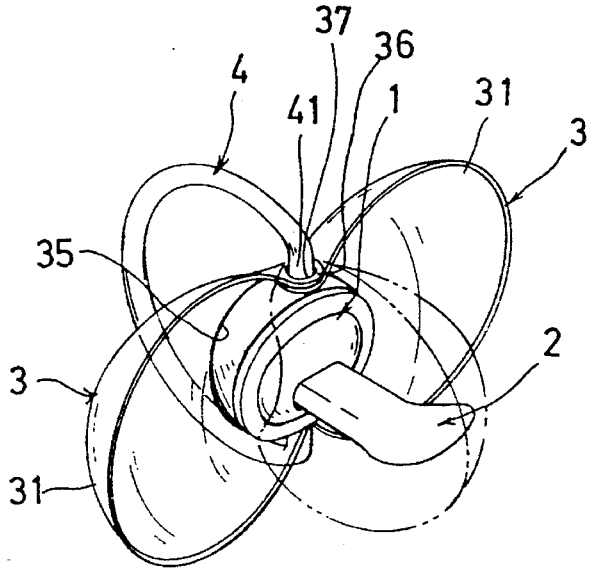
FIG. 9 shows still another preferred embodiment of the present invention.

As shown in FIG. 9, each half-shell piece 31 is modified to include a pair of hinge tabs 36 laterally protruding from each half-shell piece 31, and a shaft hole 37 formed in each hinge tab 36, two hinge tabs 36 of the two half-shell pieces 31 are overlapped to align two shaft holes 37 formed in the two hinge tabs 36 for engaging each shaft portion 41 of the handle 4 pivotally secured to the base member i for pivotally securing the two half-shell pieces 31 on two shaft portions 41 of the handle 4 for hingedly securing the two half-shell pieces 31 of the shell 3 on the base member 1.

The present invention may be modified without departing from the spirit and scope of the present invention. Each pivoting slot 13 may also be modified to be two adjacent pivot holes, each pivot hole pivotally engaging each of the two pivot portions 33 of the half-shell piece 31.

I claim:

1. A hygienic pacifier comprising:

a base member;

a nipple member having a nipple portion protruding from a first side of the base member;

a handle secured to the base member on a second side of the base member; and a bivalve shell hingedly secured to the base member and having a pair of half-shell pieces operatively separable and openable beyond a baby's mouth to reveal the nipple portion to be soothed by the baby, and the pair of half-shell pieces foldably closable for shielding the nipple portion within the pair of half-shell pieces for preventing contamination of the nipple portion.

2. A hygienic pacifier according to claim 1, wherein said base member includes: a base portion, a cover combinable with the base portion for forming the base member for securing the nipple member on the base member and having a central slot cut in a central portion of the cover for protruding the nipple member outwardly from the cover, a pair of pivoting slots formed in two opposite side portions of the base portion for pivotally connecting the bivalve shell, a pair of shaft holes formed in two opposite side portions of the base portion for pivotally connecting the handle, and a plugging stem protruding from the base portion towards the nipple member.

3. A hygienic pacifier according to claim 2, wherein said nipple member includes: a nipple portion, and a shank portion integrally formed with the nipple portion having a flange portion formed on a bottom portion of the shank portion to be retained on the cover and having a hollow portion formed in the flange portion to be engaged with the plugging stem of the base member for combining the nipple member with the base member.

4. A hygienic pacifier according to claim 2, wherein said handle is formed in an U shape having a pair of shaft portions disposed on two opposite ends of the handle, each said shaft portion pivotally engageable with each said shaft hole formed in the base member for pivotally connecting the handle on the base member.

5. A hygienic pacifier according to claim 1, wherein said bivalve shell includes: said pair of half-shell pieces hingedly secured to the base member; each said half-shell piece including a peripheral ring formed on a periphery of the half-shell piece, and a pair of pivot portions disposed on two opposite ends of the ring, each said pivot portion engageable with each of the two pivoting slots formed in two opposite side portions of the base member for pivotally engaging each said half-shell piece about said pivoting slots in the base member for separably opening the two half-shell pieces for revealing the nipple portion of the nipple member for a baby's soothing.

6. A hygienic pacifier according to claim 5, wherein each said half-shell piece has a retaining portion formed on an end portion of each said pivot portion to be limited within each said pivoting slot formed in the base member, and a notch formed in an inner portion of the half-shell piece to allow a free pivotal movement of the half-shell piece on the base member without being obstructed.

7. A hygienic pacifier according to claim 1, wherein said pair of half-shell pieces include a first half-shell piece and a second half-shell piece hinged together, said first half-shell piece formed with a first gear on an inner end of a pivot portion of said first half-shell piece intermeshed with a second gear formed on a pivot portion of said second half-shell piece, whereby upon an inward biasing of said first half-shell piece, said second half-shell piece will be inwardly biased as driven by the first and second gears meshed together for automatically closing the first and second half-shell pieces for shielding the nipple portion therein.

8. A hygienic pacifier comprising:

a base member;

a nipple member having a nipple portion protruding from a first side of the base member;

a handle having a pair of shaft portions pivotally secured to the base member on a second side of the base member; and a bivalve shell hingedly secured to the base member and having a pair of half-shell pieces separable and openable beyond a baby's mouth to reveal the nipple portion to be soothed by the baby, and the pair of half-shell pieces foldably closed for shielding the nipple portion within the pair of half-shell pieces for preventing contamination of the nipple portion;

each said half-shell piece having a pair of hinge tabs laterally protruding from each said half-shell piece, and a shaft hole formed in each said hinge tab, two said hinge tabs of the two half-shell pieces overlapped to align two said shaft holes formed in the two hinge tabs of the two-shell pieces for engaging each said shaft portion of the handle for pivotally securing the two half-shell pieces on said two shaft portions of the handle for hingedly securing the two half-shell pieces of the shell on the base member.

* * * * *